US007780413B2

(12) United States Patent
Liang

(10) Patent No.: US 7,780,413 B2
(45) Date of Patent: Aug. 24, 2010

(54) TURBINE AIRFOIL WITH NEAR WALL INFLOW CHAMBERS

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 366 days.

(21) Appl. No.: 11/497,122

(22) Filed: Aug. 1, 2006

(65) Prior Publication Data

US 2010/0104419 A1 Apr. 29, 2010

(51) Int. Cl.
*F01D 5/18* (2006.01)

(52) U.S. Cl. ..... 416/97 R

(58) Field of Classification Search ..... 416/96 R, 416/97 R

See application file for complete search history.

(56) References Cited

U.S. PATENT DOCUMENTS

| | | | | |
|---|---|---|---|---|
| 3,799,696 | A | 3/1974 | Redman et al. | |
| 4,573,865 | A | 3/1986 | Hsia et al. | |
| 5,320,485 | A * | 6/1994 | Bourguignon et al. | 415/115 |
| 5,720,431 | A * | 2/1998 | Sellers et al. | 416/97 R |
| 5,813,836 | A | 9/1998 | Starkweather | |
| 5,975,851 | A | 11/1999 | Liang | |
| 6,126,396 | A | 10/2000 | Doughty et al. | |
| 6,183,198 | B1 | 2/2001 | Manning et al. | |
| 6,206,638 | B1 | 3/2001 | Glynn et al. | |
| 6,234,753 | B1 | 5/2001 | Lee | |
| 6,254,334 | B1 * | 7/2001 | LaFleur | 415/115 |
| 6,270,317 | B1 * | 8/2001 | Manning et al. | 416/97 R |
| 6,273,682 | B1 | 8/2001 | Lee | |
| 6,283,708 | B1 * | 9/2001 | Zelesky | 416/97 R |
| 6,422,819 | B1 * | 7/2002 | Tsai et al. | 416/97 R |
| 6,428,273 | B1 * | 8/2002 | Keith et al. | 416/97 R |
| 6,514,042 | B2 * | 2/2003 | Kvasnak et al. | 416/97 R |
| 6,533,547 | B2 * | 3/2003 | Anding et al. | 416/97 R |
| 6,773,230 | B2 * | 8/2004 | Bather et al. | 416/97 R |
| 6,837,683 | B2 | 1/2005 | Dailey | |
| 6,890,153 | B2 | 5/2005 | Demers et al. | |
| 6,929,445 | B2 | 8/2005 | Zatorski et al. | |
| 7,033,136 | B2 * | 4/2006 | Botrel et al. | 415/115 |
| 2005/0031452 | A1 * | 2/2005 | Liang | 416/97 R |
| 2005/0226726 | A1 | 10/2005 | Lee et al. | |
| 2006/0002788 | A1 | 1/2006 | Liang | |

FOREIGN PATENT DOCUMENTS

| | | | |
|---|---|---|---|
| GB | 2246174 A | * | 1/1992 |

* cited by examiner

*Primary Examiner*—Edward Look
*Assistant Examiner*—Ryan H Ellis

(57) ABSTRACT

A turbine airfoil usable in a turbine engine and having at least one cooling system. At least a portion of the cooling system may be positioned in an outer wall of the turbine airfoil for receiving cooling fluids from a cooling fluid supply source, passing those fluids through the chambers in the outer wall, and exhausting those fluids into central cooling fluids collection chambers. The outer wall may include a plurality of outer wall cooling chambers that may be configured to pass cooling fluids in a counter flow direction. The outer wall cooling chambers may include a plurality of ribs including a plurality of impingement orifices for increasing the cooling efficiency of the cooling system.

11 Claims, 5 Drawing Sheets

10
12
24
31
16
20
28
44
20
144
46
14
26
106
94
114
24
100
20
3
48
98
102
96
110
108
40
104
22
18
22
114
3
102
102
92
28
60
30
14
18
112
62
22
114
42

TURBINE AIRFOIL WITH NEAR WALL INFLOW CHAMBERS

FIELD OF THE INVENTION

This invention is directed generally to turbine airfoils, and more particularly to hollow turbine airfoils having cooling channels for passing fluids, such as air, to cool the airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine vanes are formed from an elongated portion forming a vane having one end configured to be coupled to a vane carrier and an opposite end configured to be movably coupled to an inner endwall. The vane is ordinarily composed of a leading edge, a trailing edge, a suction side, and a pressure side. The inner aspects of most turbine vanes typically contain an intricate maze of cooling circuits forming a cooling system. The cooling circuits in the vanes receive air from the compressor of the turbine engine and pass the air through the ends of the vane adapted to be coupled to the vane carrier. The cooling circuits often include multiple flow paths that are designed to maintain all aspects of the turbine vane at a relatively uniform temperature. At least some of the air passing through these cooling circuits is exhausted through orifices in the leading edge, trailing edge, suction side, and pressure side of the vane. While advances have been made in the cooling systems in turbine vanes, a need still exists for a turbine vane having increased cooling efficiency for dissipating heat and passing a sufficient amount of cooling air through the vane.

SUMMARY OF THE INVENTION

This invention relates to a turbine airfoil having an internal cooling system for removing heat from the turbine airfoil. The turbine airfoil may be formed from a generally elongated hollow airfoil having a leading edge, a trailing edge, a pressure side, a suction side, a first end adapted to be coupled to a hook attachment, a second end opposite the first end and adapted to be coupled to an inner endwall, and a cooling system in the outer wall. The cooling system may be formed from one or more pressure side outer wall chambers and one or more suction side outer wall chambers positioned in the outer wall of the turbine airfoil. The pressure and suction side outer wall chambers may be configured to receive cooling fluids directly from a cooling fluid supply source, such as a compressor (not shown), and pass the cooling fluids into one or more central cooling fluid collection chambers to cool internal aspects of the turbine airfoil. Passing the cooling fluids through the pressure and suction side outer wall chambers first before passing the cooling fluids through other portions of the cooling system provides enhanced cooling capabilities to the turbine airfoil and reduces stress inducing temperature gradients that exist at operating conditions between the outer wall and internal aspects, such as internal ribs, of the turbine airfoil.

The pressure and suction side outer wall chambers may each include one or more chambers. In one embodiment, the suction side outer wall chamber may include a forward, mid, and aft suction side outer wall chamber. The pressure side outer wall chamber may include a forward and aft pressure side outer wall chamber. The pressure and suction side outer wall chambers may include ribs with impingement orifices for increasing the effectiveness of the cooling system. In particular, the pressure and suction side outer wall chambers may include a repeating pattern of ribs having impingement holes that are offset generally in the spanwise direction relative to impingement orifices in a downstream rib. In such a configuration, cooling fluids passing through the impingement ribs impinge on the rib downstream of the impingement holes and reduce the temperature of that rib.

The pressure and suction side outer wall chambers may be coupled to a central cooling fluid collection chamber through a pressure side cooling fluid turn and a suction side cooling fluid turn, respectively. The pressure side cooling fluid turn may be formed from forward and aft pressure side cooling fluid turns in communication with the forward and aft pressure side outer wall chambers, respectively. The suction side cooling fluid turn may be formed from forward, mid, and aft suction side cooling fluid turns in communication with the forward, mid, and aft suction side outer wall chambers, respectively.

The cooling system may also include one or more central cooling fluid collection chambers configured to receive cooling fluids from the pressure and suction side outer wall chambers. In one embodiment, the central cooling fluid collection chamber may be formed from a forward, mid, and aft central cooling fluid collection chamber. The cooling system may also include a leading edge impingement chamber in communication with the forward central cooling fluid collection chamber through one or more impingement orifices. The leading edge impingement chamber may exhaust cooling fluids from the airfoil through one or more film cooling orifices forming a showerhead. The cooling system may also include a trailing edge impingement chamber in communication with the aft central cooling fluid collection chamber through one or more impingement orifices. The trailing edge impingement chamber may exhaust cooling fluids from the airfoil through one or more trailing edge exhaust orifices. Cooling fluids may also be exhausted from the central cooling fluid collection chambers through one or more film cooling orifices.

During operation, the cooling fluids flow from a cooling fluid supply source through an endwall at the OD of the turbine airfoil. The cooling fluids may flow into the pressure and suction side outer wall chambers. The cooling fluids increase in temperature upon receiving heat from the turbine airfoil as the cooling fluids flow through the impingement orifices of the suction and pressure side outer wall chambers. In particular, as cooling fluids flow through the impingement orifices the cooling fluids impinge on the rib and cool the rib. Similarly, as cooling fluids flow through the impingement orifices, the cooling fluids impinge on the rib and cool the rib. This cooling mechanism is repeated throughout the pressure and suction side outer wall chambers. The cooling fluids then flow through the pressure or suction side cooling fluid turns and into the central cooling fluid collection chamber. Cooling fluids flow into the forward, mid, and aft central cooling fluid collection chambers. The cooling fluids entering the forward, mid, and aft central cooling fluid collection chambers have been heated while passing through the pressure and suction side outer wall chambers. As a result, a smaller temperature gradient is established between the ribs forming the forward, mid, and aft central cooling fluid collection chambers and the outer wall than in conventional airfoils. The cooling fluids may be expelled out of the central cooling fluid collection chamber and into the leading edge impingement chamber, the trailing edge impingement chamber, and through film cooling holes in the outer wall of the airfoil. The cooling fluids maybe exhausted from the leading edge impingement chamber through a plurality of film cooling holes extending through the outer wall forming a showerhead, a pressure side film cooling hole, and a suction side film cooling hole. The cooling fluids may be exhausted from the trailing edge impingement chamber through exhaust orifices extending through the outer wall of the trailing edge.

An advantage of this invention is that each individual cooling circuit formed from the pressure and suction side outer wall chambers may be independently designed based on local heat load and aerodynamic pressure loading conditions.

Another advantage of this invention is that the multiple impingement ribs having the multiple impingement orifices in the pressure and suction side outer wall chambers enables the airfoil cooling system to easily be reconfigured for cooling demand growth in other portions of the turbine engine.

Yet another advantage of this invention is that the cooling fluid flow is metered with the impingement ribs in the pressure and suction side outer wall chambers thereby yielding an excellent cooling fluid control device.

Another advantage of this invention is that the pressure and suction side outer wall chambers are separated from each other which thus eliminates conventional non-uniform distribution of mid-chord cooling fluid flow due to pressure variations in the mid-chord.

Still another advantage of this invention is that the configuration of the pressure and suction side outer wall chambers receiving the cooling fluids first reduces the thermal gradient present between the outer wall of turbine engine and the inner aspects of the airfoil under steady state operating conditions as compared with conventional designs. This is the case because relatively cold cooling fluids are first passed through the pressure and suction side outer wall chambers where the cooling fluids are heated. The heated cooling fluids are then passed to the central cooling fluid collection chambers at a temperature greater than when the cooling fluids entered the pressure and suction side outer wall chambers.

Another advantage of this invention is that the film cooling holes positioned in the outer walls and in communication with the central cooling fluids collection chambers have longer lengths than conventional film cooling orifices coupled to near wall cooling chambers. Such a configuration enables the film cooling orifices to have a well defined geometry, which is difficult to obtain with film cooling orifices extending from near wall cooling chambers.

Yet another advantage of this invention is that the cooling fluids flowing in the suction and pressure side outer wall chambers and through the plurality of impingement orifices spread out around the impingement jet stagnation points through the impingement cavities formed by the ribs in the suction and pressure side outer wall chambers and contact and cool the walls forming these components of the airfoil. This additional cooling characteristic increases the efficiency of the cooling system.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
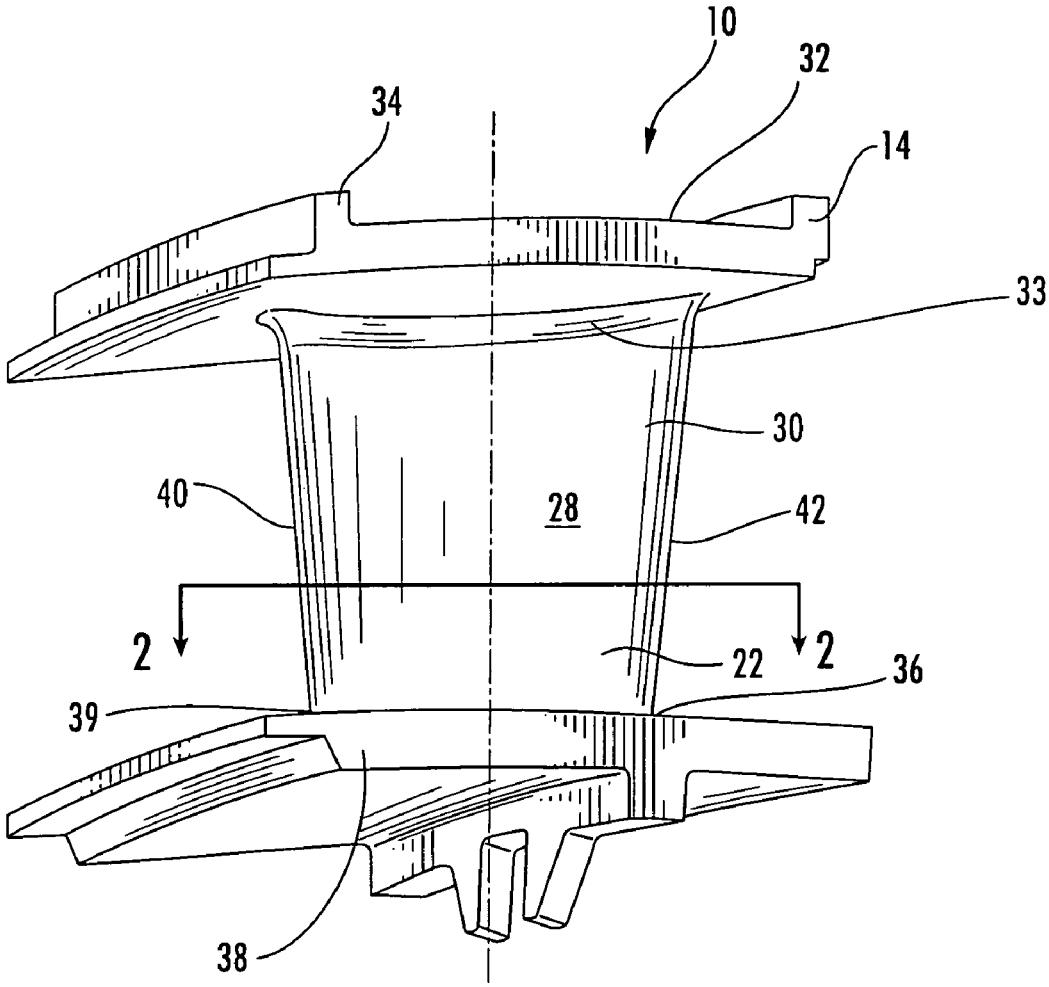
FIG. 1 is a perspective view of a turbine airfoil having features according to the instant invention.

As shown in FIGS. 1-5, this invention is directed to a turbine airfoil 10 having a cooling system 12 in inner aspects of the turbine airfoil 10 for use in turbine engines. The cooling system 12 may be used in any turbine vane or turbine blade. While the description below focuses on a cooling system 12 in a turbine vane 10, the cooling system 12 may also be adapted to be used in a turbine blade. The cooling system 12 may be configured such that adequate cooling occurs within an outer wall 14 of the turbine vane 10 by including one or more cavities 16 in the outer wall 14 and configuring each cavity 16 based on local external heat loads and airfoil gas side pressure distribution in both chordwise and spanwise directions. The chordwise direction is defined as extending between a leading edge 40 and a trailing edge 42 of the airfoil 10. The spanwise direction is defined as extending between an inner endwall 38 and an endwall 32 at the first end 33. In particular, the cooling system 12 may include one or more pressure side outer wall chambers 18 and one or more suction side outer wall chambers 20 positioned in the outer wall 14 of the turbine airfoil 10. The pressure and suction side outer wall chambers 18, 20 may be configured to receive cooling fluids directly from a cooling fluid supply source, such as a compressor (not shown), and pass the cooling fluids into one or more central cooling fluid collection chambers 22 to cool internal aspects of the turbine airfoil 10. Passing the cooling fluids through the pressure and suction side outer wall chambers 18, 20 first before passing the cooling fluids through other portions of the cooling system provides enhanced cooling capabilities to the turbine airfoil 10 and reduces stress inducing temperature gradients that exist at operating conditions between the outer wall 14 and internal aspects, such as internal ribs 24, of the turbine airfoil 10.

Figure 2:
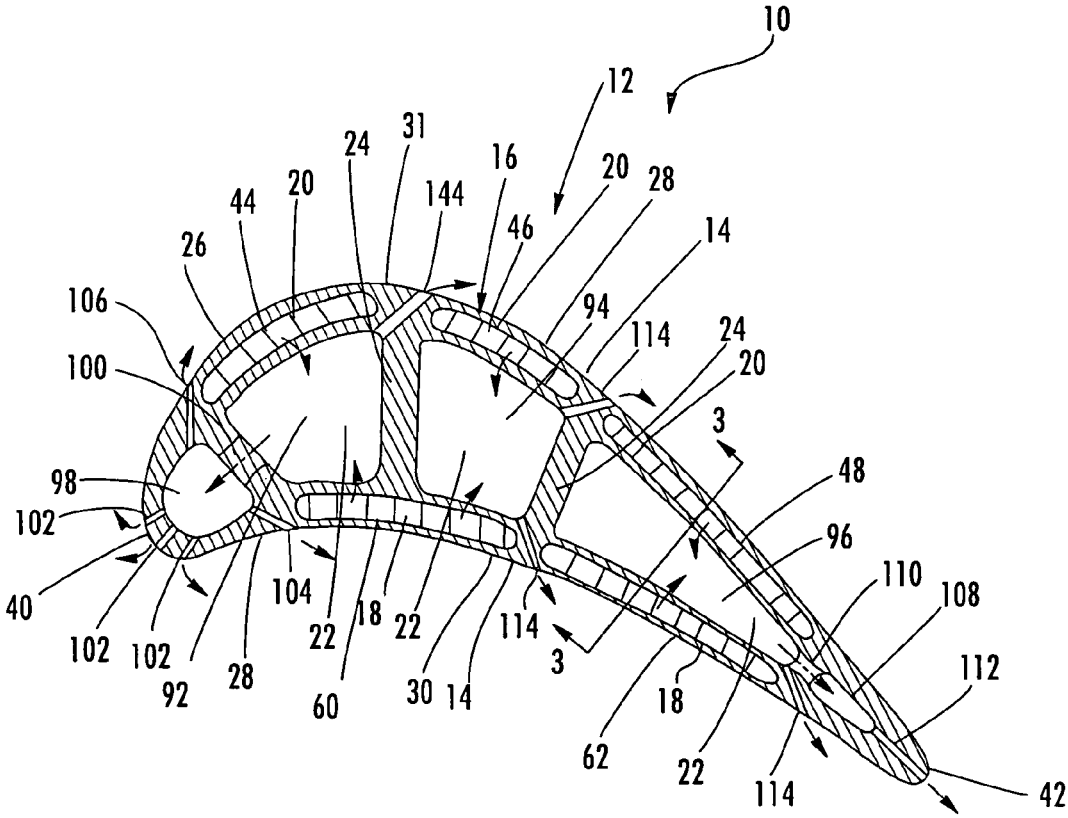
FIG. 2 is a cross-sectional view of the turbine airfoil shown in FIG. 1 taken along section line 2-2.

As shown in FIG. 1, the turbine vane 10 may be formed from a generally elongated hollow airfoil having an outer surface 28 adapted for use, for example, in an axial flow turbine engine. Outer surface 28 may have a generally concave shaped portion forming pressure side 30 and a generally convex shaped portion forming suction side 31, as shown in FIG. 2. The turbine vane 10 may also include an outer endwall 32 adapted to be coupled to a hook attachment 34 at a first end 33 and may include a second end 36 adapted to be coupled to an inner endwall 38. The airfoil 22 may also include a leading edge 40 and a trailing edge 42.

Figure 3:
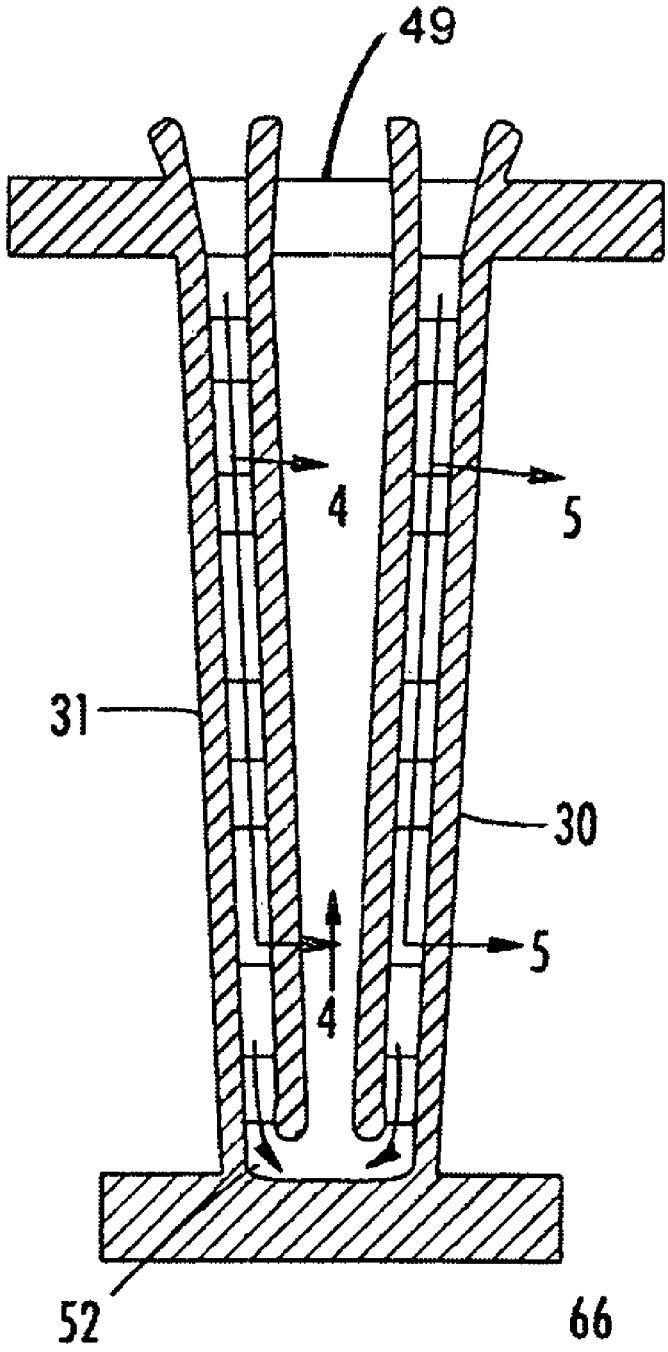
FIG. 3 is a cross-sectional view of a cooling system in the turbine airfoil shown in FIG. 2 taken along section line 3-3.

As shown in FIGS. 2 and 3, the cooling system 12 may be formed from at least one suction side outer wall chamber 20 positioned in the outer wall 14 of the airfoil and extending from proximate the first endwall 32 of the generally elongated hollow airfoil toward the second end 34. In at least one embodiment, as shown in FIG. 2, the suction side outer wall chamber 20 may be formed from a forward suction side outer wall chamber 44 positioned proximate to the leading edge 40 of the elongated hollow airfoil 26, an aft suction side outer wall chamber 48 positioned proximate to the trailing edge 42, and a mid suction side outer wall chamber 46 positioned between the forward and aft pressure side outer wall chambers 44, 48. One or more of the forward, mid, and aft suction side outer wall chambers 44, 46, 48 may be in communication with a suction side inlet opening 49 in an OD endwall 32 of the turbine airfoil 10 at the first end 33 of the generally elongated hollow airfoil 26. The suction side inlet opening may establish a cooling fluid channel between an OD cooling fluid supply, such as a compressor (not shown) and the forward, mid, and aft pressure side outer wall chambers 44, 46, 48. In at least one embodiment, the suction side outer wall chambers 44, 46, 48 may extend from the endwall 32 at the first end 33 to the inner endwall 38 at the second end 36, as shown in FIG. 2.

The suction side outer wall chambers 20 may be in fluid communication with the central cooling fluids collection chambers 22 through one or more suction side cooling fluid turns 52 that coupling the suction side outer wall chambers 20 to the central cooling fluid collection chamber 22. The suction side cooling fluid turn 52 may be positioned between the first end 33 and the second end 36. In at least one embodiment, the suction side cooling fluid turn 52 may be positioned in close proximity to the inner endwall 38, as shown in FIG. 3, such that the inner endwall 38 forms a portion of the suction side cooling fluid turn 52. One or more suction side cooling fluid turns 52 may be used to couple the suction side outer wall chambers 18 to the central cooling fluid collection chamber 22. In at least one embodiment, the suction side cooling fluid turn 52 may be formed from a forward, mid, and aft suction side cooling fluid turn. The forward, mid, and aft suction side cooling fluid turns may be in fluid communication with the corresponding forward, mid, and aft suction side outer wall chambers 44, 46, 48.

As shown in FIGS. 2 and 3, the cooling system 12 may be formed from at least one pressure side outer wall chamber 18 positioned in the outer wall 14 of the airfoil and extending from proximate the first endwall 32 of the generally elongated hollow airfoil toward the second end 34. In at least one embodiment, as shown in FIG. 2, the pressure side outer wall chamber 18 may be formed from a forward pressure side outer wall chamber 60 positioned proximate to the leading edge 40 of the elongated hollow airfoil 26 and an aft pressure side outer wall chamber 62 positioned proximate to the trailing edge 42. One or both of the forward and aft pressure side outer wall chambers 60, 62 may be in communication with a pressure side inlet opening in an OD endwall 32 of the turbine airfoil 10 at the first end 33 of the generally elongated hollow airfoil 26. The pressure side inlet opening may establish a cooling fluid channel between an OD cooling fluid supply, such as a compressor (not shown) and the forward and aft pressure side outer wall chambers 60, 62. In at least one embodiment, the pressure side outer wall chambers 60, 62 may extend from the endwall 32 at the first end 33 to the inner endwall 38 at the second end 36, as shown in FIG. 2.

The pressure side outer wall chambers 18 may be in fluid communication with the central cooling fluids collection chambers 22 through one or more pressure side cooling fluid turns 66 that couple the pressure side outer wall chambers 18 to the central cooling fluid collection chamber 22. The pressure side cooling fluid turn 66 may be positioned between the first end 33 and the second end 36 of the elongated hollow airfoil 26. In at least one embodiment, the pressure side cooling fluid turn 66 may be positioned in close proximity to the inner endwall 38, as shown in FIG. 3, , such that the inner endwall 38 forms a portion of the pressure side cooling fluid turn 66. One or more pressure side cooling fluid turns 66 may be used to couple the pressure side outer wall chambers 18 to the central cooling fluid collection chamber 22. In at least one embodiment, the pressure side cooling fluid turn 66 may be formed from a forward and aft pressure side cooling fluid turn. The forward and aft pressure side cooling fluid turns may be in fluid communication with the corresponding forward and aft pressure side outer wall chambers 60, 62.

Figure 4:
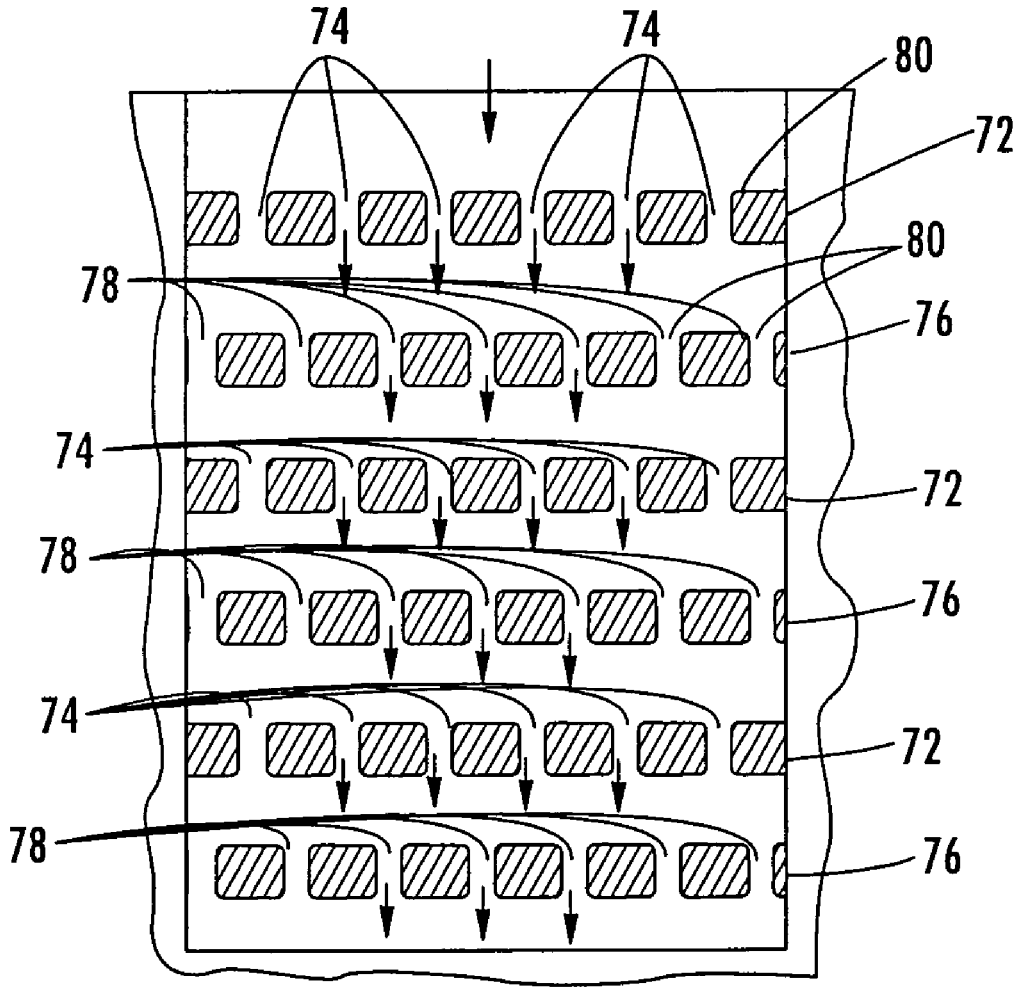
FIG. 4 is a cross-sectional view of the turbine airfoil taken along section line 4-4 in FIG. 3.

As shown in FIGS. 2 and 3, and in detail in FIG. 4, the pressure and suction side outer wall chambers 18, 20 include one or more ribs having one or more impingement orifices for increasing the heat transfer between the cooling fluids passing through the cooling system 12 and the turbine airfoil 10. As shown in FIG. 4, the suction side outer wall chamber 20 includes a first rib 72 including a plurality of impingement orifices 74 and includes a second rib 76 including a plurality of impingement orifices 78 positioned downstream from the first rib 72. The plurality of impingement orifices 74 in the first rib 72 may be offset in a general chordwise direction relative to the plurality of impingement orifices 78 in the second rib 76. The offset pattern between the impingement orifices 74, 78 of the first and second ribs 72, 76 forms a repeating pattern that may be positioned in portions of or entirely between the first end 33 and the second end 36. The repeating pattern of offset impingement orifices 74, 78 may be positioned in the forward, mid, and aft suction side outer wall chambers 44, 46, 48. One or more of the impingement orifices 74, 78 may include a bell-shaped mouth 80, as shown in FIG. 4, to decrease head loss of cooling fluids flowing through the impingement orifices 74, 78. The ribs 72, 76 may be extend generally spanwise and be positioned orthogonal to cooling fluid flow. In other embodiments, the ribs 72, 76 may be positioned at other angles relative to fluid flow.

Figure 5:
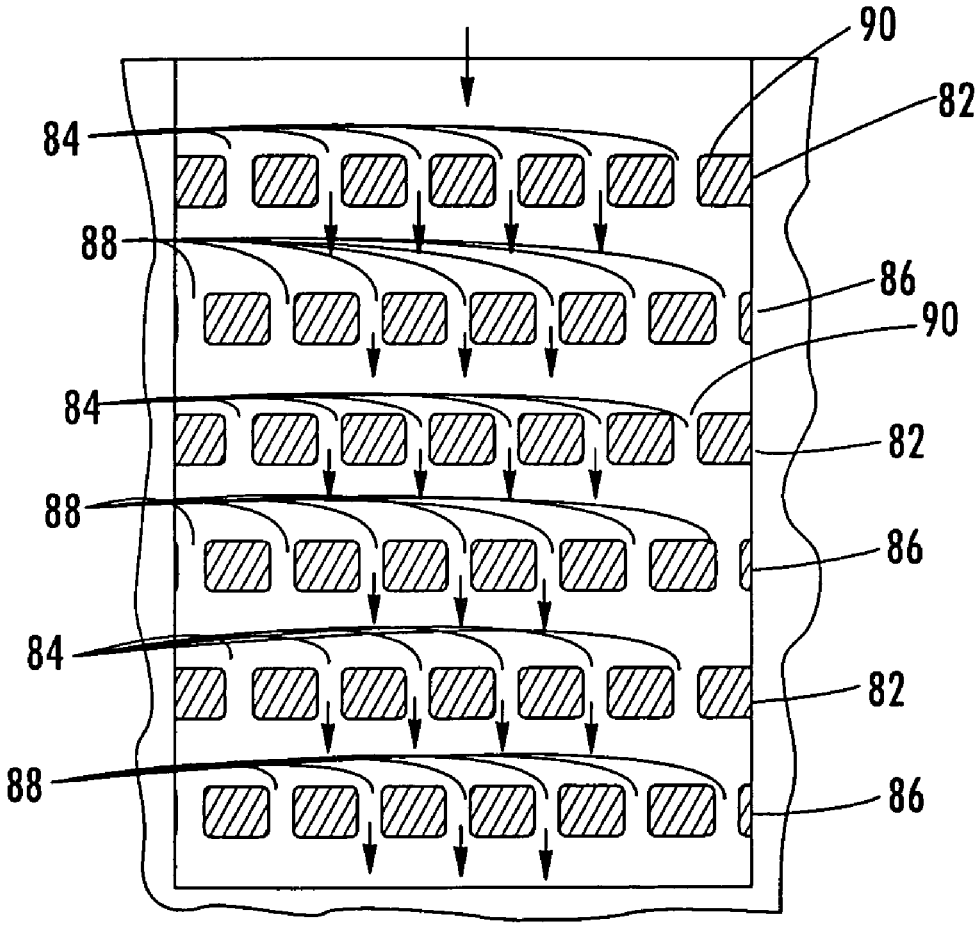
FIG. 5 is a cross-sectional view of the turbine airfoil taken along section line 5-5 in FIG. 3.

As shown in FIG. 5, the pressure side outer wall chamber 18 includes a first rib 82 including a plurality of impingement orifices 84 and includes a second rib 86 including a plurality of impingement orifices 88 positioned downstream from the first rib 82. The plurality of impingement orifices 84 in the first rib 82 may be offset in a general chordwise direction relative to the plurality of impingement orifices 88 in the second rib 86. The offset pattern between the impingement orifices 84, 88 of the first and second ribs 82, 86 forms a repeating pattern that may be positioned in portions of or entirely between the first end 33 and the second end 36. The repeating pattern of offset impingement orifices 84, 88 may be positioned in the forward and aft pressure side outer wall chambers 60, 62. One or more of the impingement orifices 84, 88 may include a bell-shaped mouth 90, as shown in FIG. 5, to decrease head loss of cooling fluids flowing through the impingement orifices 84, 88. The ribs 82, 86 may be extend generally spanwise and be positioned orthogonal to cooling fluid flow. In other embodiments, the ribs 82, 86 may be positioned at other angles relative to fluid flow.

As shown in FIG. 2, the central cooling fluid collection chamber 22 may be formed from a plurality of chambers. In particular, the central cooling fluid collection chamber 22 may be formed from a forward central cooling fluid collection chamber 92, an aft central cooling fluid collection chamber 96, and a mid central cooling fluid collection chamber 94 positioned between the forward and aft central cooling fluid collection chambers 92, 96. The forward, mid, and aft central cooling fluid collection chambers 92, 94, 96 may be in fluid communication with the pressure and suction side outer wall chambers 18, 20. In particular, the forward central cooling fluid collection chamber 92 may be in fluid communication with the forward suction side outer wall chamber 44 and the forward pressure side outer wall chamber 60. The mid central cooling fluid collection chamber 94 may be in fluid communication with the mid suction side outer wall chamber 46 and the forward pressure side outer wall chamber 60. The aft central cooling fluid collection chamber 94 may be in fluid communication with the aft suction side outer wall chamber 48 and the aft pressure side outer wall chamber 62. Thus, the central cooling fluid collection chambers 22 may receive cooling fluids from the pressure or suction side outer wall chambers 18, 20.

The central cooling fluid collection chambers 22 may exhaust cooling fluids through numerous channels. As shown in FIG. 2, the cooling fluid collection chamber 22, and specifically, the forward cooling fluid collection chamber 92, may be in communication with a leading edge impingement chamber 98 through one or more impingement orifices 100. The leading edge impingement chamber 98 may include a plurality of film cooling holes 102 extending through the outer wall 14 forming a showerhead. A pressure side film cooling hole 104 and a suction side film cooling hole 106 may be positioned in the outer wall 14 as well and be in fluid communication with the leading edge impingement chamber 98. The leading edge impingement chamber 98 may extend from the first end 33 to the second edge 36 of the elongated hollow airfoil 26 or may have a shorter length.

As shown in FIG. 2, the cooling fluid collection chamber 22, and specifically, the aft cooling fluid collection chamber 92, may be in communication with a trailing edge impingement chamber 108 through one or more impingement orifices 110. The trailing edge impingement chamber 108 may include a plurality of trailing edge exhaust orifices 112 extending through the outer wall 14 of the trailing edge 42. The trailing edge impingement chamber 108 may extend from the first end 33 to the second end 36 of the elongated hollow airfoil 26 or may have a shorter length.

The central cooling fluid collection chambers 22 may also exhaust cooling fluids through one or more film cooling holes 114. In particular, the forward central cooling fluid collection chamber 92 may exhaust cooling fluids through one or more film cooling holes 114 on the suction side 31. The mid central cooling fluid collection chambers 94 may exhaust cooling fluids through one or more film cooling holes 114 on the suction side 31, the pressure side 30, or both. The aft central cooling fluid collection chambers 96 may exhaust cooling fluids through one or more film cooling holes 114 on the pressure side 30.

During operation, the cooling fluids flow from a cooling fluid supply source (not shown) through the endwall 32 at the OD of the turbine airfoil 10. The cooling fluids flow into the pressure and suction side outer wall chambers 18, 20. The cooling fluids increase in temperature upon receiving heat from the turbine airfoil 26 as the cooling fluids flow through the impingement orifices 74, 78, 84, 88 of the suction and pressure side outer wall chambers 20, 18. In particular, as cooling fluids flow through the impingement orifices 74, the cooling fluids impinge on the rib 76 and cool the rib 76. Similarly, as cooling fluids flow through the impingement orifices 84, the cooling fluids impinge on the rib 86 and cool the rib 86. The cooling fluids may also flow through impingement orifices 78 or 88 and impinge on ribs 72 or 82, respectively. The cooling fluids also spread out through the impingement cavities formed by the ribs 72, 76, 82, 86 in the suction and pressure side outer wall chambers 20, 18 and contact and cool the walls forming these components of the airfoil 10. This cooling mechanism is repeated throughout the pressure and suction side outer wall chambers 18, 20. The cooling fluids then flow through the pressure or suction side cooling fluid turns 66, 52 and into the central cooling fluid collection chamber 22. Cooling fluids flow into the forward, mid, and aft central cooling fluid collection chambers 92, 94, 96. The cooling fluids entering the forward, mid, and aft central cooling fluid collection chambers 92, 94, 96 have been heated while passing through the pressure and suction side outer wall chambers 18, 20. As a result, a smaller temperature gradient is established between the ribs 24 forming the forward, mid, and aft central cooling fluid collection chambers 92, 94, 96 and the outer wall 14 than in conventional airfoils.

The cooling fluids may be expelled out of the central cooling fluid collection chamber 22 and into the leading edge impingement chamber 98, the trailing edge impingement chamber 108, and the film cooling holes 114. In particular, cooling fluids may pass from the forward central cooling fluid chamber 92 and into the leading edge impingement chamber 98 through impingement orifices 100. The cooling fluids may be exhausted from the leading edge impingement chamber 98 through the plurality of film cooling holes 102 extending through the outer wall 14 forming a showerhead, the pressure side film cooling hole 104, and the suction side film cooling hole 106. The cooling fluids may pass from the forward central cooling fluid chamber 92 and into the trailing edge impingement chamber 108 through one or more impingement orifices 110. The cooling fluids may be exhausted from the trailing edge impingement chamber 108 through exhaust orifices 112 extending through the outer wall 14 of the trailing edge 42. The central cooling fluid collection chambers 22 may also exhaust cooling fluids through the film cooling holes 114. In particular, the forward central cooling fluid collection chamber 92 may exhaust cooling fluids through one or more film cooling holes 114 on the suction side 31. The mid central cooling fluid collection chambers 94 may exhaust cooling fluids through one or more film cooling holes 114 on the suction side 31, the pressure side 30, or both. The aft central cooling fluid collection chambers 96 may exhaust cooling fluids through one or more film cooling holes 114 on the pressure side 30.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated hollow airfoil formed from an outer wall, and having a leading edge, a trailing edge, a pressure side, a suction side, a first end adapted to be coupled to a hook attachment, a second end opposite the first end adapted to be coupled to an inner endwall; and a cooling system in inner aspects of the generally elongated hollow airfoil; wherein the cooling system comprises:

at least one pressure side outer wall chamber positioned in the outer wall of the airfoil, extending from proximate the first end of the generally elongated hollow airfoil toward the second end, and in fluid communication with a cooling fluid supply channel;

at least one suction side outer wall chamber positioned in the outer wall of the airfoil and extending from proximate the first end of the generally elongated hollow airfoil toward the second end;

at least one central cooling fluid collection chamber positioned between the pressure and suction sides of the generally elongated hollow airfoil;

at least one pressure side cooling fluid turn coupling the at least one pressure side outer wall chamber to the at least one central cooling fluid collection chamber that supplies cooling fluids from the at least one pressure side outer wall chamber to the at least one central cooling fluid collection chamber;

at least one suction side cooling fluid turn coupling the at least one suction side outer wall chamber to the at least one central cooling fluid collection chamber that supplies cooling fluids from the at least one suction side outer wall chamber to the at least one central cooling fluid collection chamber; and wherein the at least one central cooling fluid collection chamber exhausts cooling fluids that are received from the at least one suction side outer wall chamber or the at least one pressure side outer wall chamber by passing the cooling fluids through at least one orifice extending through the outer wall of the generally elongated hollow airfoil;

wherein the at least one central cooling fluid collection chamber comprises a forward central cooling fluid collection chamber, a mid central cooling fluid and an aft central cooling fluid collection chamber, wherein the forward suction side outer wall chamber is in fluid communication with the forward central cooling fluid collection chamber, the mid central cooling fluid chamber is in fluid communication with a mid suction side outer wall chamber positioned between the forward suction side outer wall chamber and the aft suction side outer wall chamber, and the aft suction side outer wall chamber is in fluid communication with the aft suction side outer wall chamber;

a leading edge impingement chamber extending generally spanwise in the generally elongated hollow airfoil proximate to the leading edge, wherein the leading edge impingement chamber is in fluid communication with the at least one central cooling fluid collection chamber; and a trailing edge impingement chamber extending generally spanwise in the generally elongated hollow airfoil proximate to the trailing edge, wherein the trailing edge impingement chamber is in fluid communication with the at least one central cooling fluid collection chamber.

2. The turbine airfoil of claim 1, wherein the at least one pressure side outer wall chamber comprises a forward pressure side outer wall chamber and an aft pressure side outer wall chamber.

3. The turbine airfoil of claim 1, further comprising a plurality of film cooling holes in communication with the leading edge impingement chamber and positioned in the outer wall to create a showerhead.

4. The turbine airfoil of claim 1, further comprising a plurality of trailing edge exhaust orifices in communication with the trailing edge impingement chamber and positioned in the outer wall.

5. The turbine airfoil of claim 1, wherein the at least one pressure side outer wall chamber further comprises at least one first rib including a plurality of impingement orifices and at least one second rib including a plurality of impingement orifices positioned downstream from the at least one first rib.

6. The turbine airfoil of claim 5, wherein the plurality of impingement orifices in the at least one first rib are offset in a general chordwise direction relative to the plurality of impingement orifices in the at least one second rib.

7. The turbine airfoil of claim 6, wherein the at least one first and second ribs comprises a repeating pattern of first and second ribs having offset impingement orifices.

8. The turbine airfoil of claim 1, wherein the at least one suction side outer wall chamber further comprises at least one first rib including a plurality of impingement orifices and at least one second rib including a plurality of impingement orifices positioned downstream from the at least one first rib.

9. The turbine airfoil of claim 8, wherein the plurality of impingement orifices in the at least one first rib are offset in a general chordwise direction relative to the plurality of impingement orifices in the at least one second rib.

10. The turbine airfoil of claim 9, wherein the at least one first and second ribs comprises a repeating pattern of first and second ribs having offset impingement orifices.

11. A turbine airfoil, comprising:

a generally elongated hollow airfoil formed from an outer wall, and having a leading edge, a trailing edge, a pressure side, a suction side, a first end adapted to be coupled to a hook attachment, a second end opposite the first end adapted to be coupled to an inner endwall; and a cooling system in inner aspects of the generally elongated hollow airfoil; wherein the cooling system comprises:

at least one pressure side outer wall chamber positioned in the outer wall of the airfoil, extending from proximate the first end of the generally elongated hollow airfoil toward the second end, and in fluid communication with a cooling fluid supply channel;

at least one suction side outer wall chamber positioned in the outer wall of the airfoil and extending from proximate the first end of the generally elongated hollow airfoil toward the second end;

a suction side inlet opening in an OD wall of the turbine airfoil at the first end of the generally elongated hollow airfoil that establishes a cooling fluid channel between an OD cooling fluid supply channel and the at least one suction side outer wall chamber;

at least one central cooling fluid collection chamber positioned between the pressure and suction sides of the generally elongated hollow airfoil;

at least one pressure side cooling fluid turn coupling the at least one pressure side outer wall chamber to the at least one central cooling fluid collection chamber that supplies cooling fluids from the at least one pressure side outer wall chamber to the at least one central cooling fluid collection chamber;

at least one suction side cooling fluid turn coupling the at least one suction side outer wall chamber to the at least one central cooling fluid collection chamber that supplies cooling fluids from the at least one suction side outer wall chamber to the at least one central cooling fluid collection chamber;

wherein the at least one central cooling fluid collection chamber exhausts cooling fluids that are received from the at least one suction side outer wall chamber or the at least one pressure side outer wall chamber by passing the cooling fluids through at least one orifice extending through the outer wall of the generally elongated hollow airfoil;

wherein the at least one pressure side outer wall chamber further comprises at least one first rib including a plurality of impingement orifices and at least one second rib positioned downstream from the at least one first rib; and wherein the at least one suction side outer wall chamber further comprises at least one first rib including a plurality of impingement orifices and at least one second rib positioned downstream from the at least one first rib;

wherein the at least one pressure side outer wall chamber comprises a forward pressure side outer wall chamber and an aft pressure side outer wall chamber, wherein the at least one central cooling fluid collection chamber comprises a forward central cooling fluid collection chamber and an aft central cooling fluid collection chamber, wherein the forward pressure side outer wall chamber is in fluid communication with the forward central cooling fluid collection chamber and the aft pressure side outer wall chamber is in fluid communication with the central cooling fluid collection chamber, wherein the at least one suction side outer wall chamber comprises a forward suction side outer wall chamber, an aft suction side outer wall chamber and a mid suction side outer wall chamber positioned between the forward and aft suction side outer wall chambers, wherein the at least one central cooling fluid collection chamber comprises a forward central cooling fluid collection chamber and an aft central cooling fluid collection chamber, and wherein the forward suction side outer wall chamber is in fluid communication with the forward central cooling fluid collection chamber and the aft suction side outer wall chamber is in fluid communication with the central cooling fluid collection chamber;

wherein each of the forward, mid, and aft suction side outer wall chambers and the forward and aft pressure side outer wall chambers include a repeating pattern of at least one first rib including a plurality of impingement orifices and at least one second rib positioned downstream from the at least one first rib including a plurality of impingement orifices offset in a general chordwise direction relative to the plurality of impingement orifices in the at least one first rib; and wherein the at least one central cooling fluid collection chamber comprises a forward, mid, and aft central cooling fluid collection chambers, and further comprising a leading edge impingement chamber in fluid communication with the forward central cooling fluid collection chamber and extending generally spanwise in the generally elongated hollow airfoil proximate to the leading edge, a trailing edge impingement chamber extending generally spanwise in the generally elongated hollow airfoil proximate to the trailing edge, a plurality of film cooling holes extending from the forward and mid central cooling fluid collection chambers to the outer surface, a plurality of film cooling holes in communication with the leading edge impingement chamber and positioned in the outer wall to create a showerhead, and a plurality of trailing edge exhaust orifices in communication with the trailing edge orifice chamber and positioned in the outer wall.

* * * * *